US008671590B2

(12) United States Patent
Rasmussen et al.

(10) Patent No.: US 8,671,590 B2
(45) Date of Patent: Mar. 18, 2014

(54) SHOE STABILITY LAYER APPARATUS AND METHOD

(75) Inventors: Bret Rasmussen, Salt Lake City, UT (US); Kevin Taylor, Ogden, UT (US)

(73) Assignee: Nelwood Corporation, Salt Lake City, UT (US)

( * ) Notice: Subject to any disclaimer, the term of this patent is extended or adjusted under 35 U.S.C. 154(b) by 1131 days.

(21) Appl. No.: 12/225,049

(22) PCT Filed: Mar. 30, 2007

(86) PCT No.: PCT/US2007/007920

§ 371 (c)(1),
(2), (4) Date: Sep. 11, 2008

(87) PCT Pub. No.: WO2007/123688

PCT Pub. Date: Nov. 1, 2007

(65) Prior Publication Data

US 2009/0031584 A1 Feb. 5, 2009

Related U.S. Application Data

(60) Provisional application No. 60/787,606, filed on Mar. 30, 2006.

(51) Int. Cl.

| | |
|---|---|
| ***A43B 13/12*** | (2006.01) |
| *A43B 7/14* | (2006.01) |
| *A43B 13/42* | (2006.01) |

(52) U.S. Cl.

USPC ..... 36/30 R; 36/76 R; 36/88

(58) Field of Classification Search

USPC ..... 36/76 R, 88, 91, 25 R, 28, 29, 30 R

See application file for complete search history.

(56) References Cited

U.S. PATENT DOCUMENTS

| | | | | | |
|---|---|---|---|---|---|
| 1,796,225 | A | * | 3/1931 | Tennick | 36/58.5 |
| 1,848,518 | A | * | 3/1932 | Doran | 36/182 |
| 2,826,834 | A | * | 3/1958 | Ratcliff | 36/173 |
| 3,350,795 | A | * | 11/1967 | Schlecht | 36/88 |
| 3,394,473 | A | * | 7/1968 | Romen | 36/88 |
| 4,510,700 | A | * | 4/1985 | Brown | 36/44 |
| 4,597,196 | A | * | 7/1986 | Brown | 36/44 |
| 4,718,179 | A | * | 1/1988 | Brown | 36/44 |
| 4,768,295 | A | * | 9/1988 | Ito | 36/28 |
| 4,803,747 | A | * | 2/1989 | Brown | 12/142 N |
| 5,191,727 | A | * | 3/1993 | Barry et al. | 36/107 |
| 6,021,588 | A | * | 2/2000 | Alviso | 36/102 |
| 6,247,250 | B1 | * | 6/2001 | Hauser | 36/44 |
| 6,393,734 | B1 | * | 5/2002 | Ou | 36/97 |
| 6,408,543 | B1 | * | 6/2002 | Erickson et al. | 36/100 |
| 6,421,933 | B1 | * | 7/2002 | Zamprogno | 36/43 |

(Continued)

*Primary Examiner* — Joshua J Michener
*Assistant Examiner* — Devin Barnett
(74) *Attorney, Agent, or Firm* — ALG Intellectual Property, LLC

(57) ABSTRACT

An apparatus comprising a stability layer dimensioned to be positioned within a shoe. The apparatus may comprise a stability wall extending downward from a heel portion of the stability layer. The stability wall may comprise a back section dimensioned to curve around a back side of the heel portion. The stability wall may also comprise at least one of a lateral side section and/or a medial side section. The lateral side section may extend along a lateral side of the heel portion and the medial side section may extend along a medial side of the heel portion. A method may comprise providing a stability layer and a midsole layer. The method may also comprise positioning the stability layer on the midsole layer.

31 Claims, 8 Drawing Sheets

(56) References Cited

U.S. PATENT DOCUMENTS

| | | | | |
|---|---|---|---|---|
| 6,453,578 | B1 * | 9/2002 | Yung et al. | 36/43 |
| 6,769,202 | B1 * | 8/2004 | Luthi et al. | 36/28 |
| 6,773,785 | B1 * | 8/2004 | Huang | 428/68 |
| 6,817,115 | B2 * | 11/2004 | Polifroni | 36/91 |
| 6,823,609 | B2 * | 11/2004 | Moretti | 36/30 R |
| 7,062,866 | B2 * | 6/2006 | Bussler | 36/34 R |
| 7,082,702 | B2 * | 8/2006 | Cretinon | 36/88 |
| 7,222,443 | B2 * | 5/2007 | Mitchell | 36/30 R |
| 7,401,422 | B1 * | 7/2008 | Scholz et al. | 36/44 |
| 7,591,083 | B2 * | 9/2009 | Geer et al. | 36/25 R |
| 7,637,033 | B2 * | 12/2009 | Sokolowski et al. | 36/25 R |
| 7,712,229 | B2 * | 5/2010 | Yang | 36/3 B |
| 2002/0020078 | A1 * | 2/2002 | Bressoux et al. | 36/30 R |
| 2002/0139011 | A1 * | 10/2002 | Kerrigan | 36/144 |
| 2003/0061731 | A1 * | 4/2003 | Turner et al. | 36/28 |
| 2003/0140523 | A1 * | 7/2003 | Issler | 36/37 |
| 2003/0150131 | A1 * | 8/2003 | McManus et al. | 36/28 |
| 2003/0208930 | A1 * | 11/2003 | Swigart | 36/29 |
| 2004/0148800 | A1 * | 8/2004 | Nakano | 36/30 R |
| 2004/0221484 | A1 * | 11/2004 | Wang | 36/29 |
| 2004/0226192 | A1 * | 11/2004 | Geer et al. | 36/102 |
| 2004/0250448 | A1 * | 12/2004 | Reed et al. | 36/29 |
| 2005/0022425 | A1 * | 2/2005 | Brown | 36/30 R |
| 2005/0091881 | A1 * | 5/2005 | Burgess | 36/30 R |
| 2005/0160626 | A1 * | 7/2005 | Townsend | 36/30 R |
| 2006/0021251 | A1 * | 2/2006 | Swigart et al. | 36/29 |
| 2006/0032088 | A1 * | 2/2006 | Manz et al. | 36/28 |
| 2007/0277401 | A1 * | 12/2007 | Young-Chul | 36/30 R |
| 2009/0119949 | A1 * | 5/2009 | Song | 36/103 |
| 2010/0186255 | A1 * | 7/2010 | Avar et al. | 36/10 |
| 2011/0277355 | A1 * | 11/2011 | Fahmi et al. | 36/30 R |

* cited by examiner

SHOE STABILITY LAYER APPARATUS AND METHOD

This application claims the benefit of U.S. Provisional Application No. 60/787,606, filed Mar. 30, 2006, the disclosure of which is incorporated in its entirety by this reference.

BACKGROUND

Traditional shoes typically include flat insole boards. Flat insole boards may not conform to the shape of a normal human foot. Thus, shoes with flat insole boards may often include a sock liner, a foot bed, or a shoe insole. Shoe insoles and foot beds may lose their effectiveness over time. For example, foam material in an insole may compress and lose its cushioning and support capability. Thus, insoles and/or foot beds may need to be replaced periodically.

Another problem with traditional shoes is that a high-quality foot bed (e.g., a foot bed that provides proper support) may be too costly for Original Equipment Manufacture (OEM) applications. Accordingly, a user may need to purchase; an aftermarket insole to obtain a high-quality foot bed. However, aftermarket insoles are not an ideal solution for obtaining a high-quality foot bed. Aftermarket insoles may be expensive, often costing a user an additional 20-40% of the purchase price of the shoe. Aftermarket insoles may also be too flexible and may fail to provide proper support. Furthermore, aftermarket insoles may not be designed to fit properly with a particular shoe.

SUMMARY

In certain embodiments, an apparatus may comprise a stability layer dimensioned to be positioned within a shoe. The apparatus may also comprise a stability wall extending downward from a heel portion of the stability layer. The stability wall may comprise a back section dimensioned to curve around a back side of the heel portion. The stability wall may also comprise at least one of a lateral side section and/or a medial side section. The lateral side section may extend along a lateral side of the heel portion. The medial side section may extend along a medial side of the heel portion.

According to some embodiments, the stability layer may comprise at least one of a midsole, a sock liner, or an insole. In at least one embodiment, the stability wall may be continuous through the back section, the lateral side section, and the medial side section. According to various embodiments, the stability layer may comprise the stability wall.

According to at least one embodiment, the lateral side section of the stability wall may comprise a convex portion that curves inward. In certain embodiments, the stability wall may comprise a molded material. In some embodiments, the apparatus may comprise the shoe. The shoe may comprise a midsole layer positioned below the stability layer, and the midsole layer may comprise an opening. The shoe may also comprise the stability wall, and the stability wall may be positioned within the opening. The shoe may also comprise the stability layer, and the stability layer may be positioned over the stability wall and the midsole layer.

According to at least one embodiment, the stability layer may comprise a mid-foot portion. The stability wall may comprise a mid-foot section that extends downward from the mid-foot portion of the stability layer. The mid-foot section may extend along a lateral side of the stability layer.

In certain embodiments, an apparatus may comprise a stability layer dimensioned to be positioned within a shoe. The apparatus may also comprise a stability wall extending downward from a heel portion of the stability layer. The stability wall may comprise a lateral side section extending along a lateral side of the heel portion. The stability wall may also comprise a medial side section extending along a medial side of the heel portion. The stability wall may be dimensioned to transfer a load from the lateral side section to the medial side section.

In at least one embodiment, at least one of the medial and lateral side sections may angle outward from a vertical direction. In some embodiments, the stability layer may comprise a mid-foot portion. The stability wall may comprise a mid-foot section that extends downward from the mid-foot portion of the stability layer. The stability wall may extend along a lateral side of the mid-foot portion, and the stability wall may be dimensioned to transfer a load from the lateral side section to the mid-foot section.

According to some embodiments, the stability wall may be dimensioned to induce a cupping motion of the heel portion of the stability layer. In various embodiments, the stability layer may comprise an opening in the heel portion. According to certain embodiments, a perimeter of the heel section of the stability layer may comprise a plurality of slits. In some embodiments, the stability layer may comprise a heel counter.

According to at least one embodiment, the apparatus may comprise a shoe. The shoe may comprise an outsole layer. The shoe may also comprise a midsole layer positioned above the outsole layer. The midsole layer may comprise an opening. The stability wall may be positioned within the opening. The lateral side of the stability wall may comprise a first convex portion that curves inward, and the medial side of the stability wall may comprise a second convex portion that curves inward.

According to various embodiments, the apparatus may comprise a top sheet positioned above the stability layer, and the top sheet may comprise a toe cover. In at least one embodiment, the stability layer may comprise a heel counter. In certain embodiments, the apparatus may comprise a stiffening shank positioned below the stability layer.

According to some embodiments, a method may comprise providing a stability layer dimensioned to be positioned within a shoe. The stability layer may comprise a stability wall extending downward from a heel portion of the stability layer. The method may also comprise providing a midsole layer, and the midsole layer may comprise an opening. The method may further comprise positioning the stability layer on the midsole layer by sliding the stability wall into the opening of the midsole layer.

According to some embodiments, the method may further comprise manufacturing the stability layer using an ethyl-vinyl-acetate compression process. In certain embodiments, the method may comprise forming an outsole layer under the midsole layer. The method may also comprise providing a top sheet layer over the stability layer.

BRIEF DESCRIPTION OF THE DRAWINGS

The accompanying drawings illustrate a number of exemplary embodiments and are part of the specification. Together with the following description these drawings demonstrate and explain various principles of the instant disclosure.

DETAILED DESCRIPTION OF EXEMPLARY EMBODIMENTS

Figure 1:
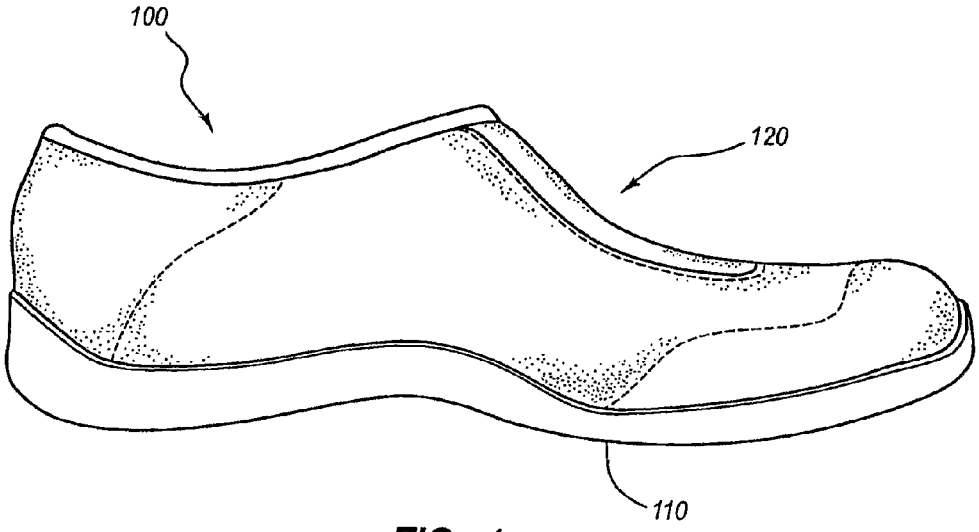
FIG. 1 is a side view of an exemplary shoe according to certain embodiments.

Throughout the drawings, identical reference characters and descriptions indicate similar, but not necessarily identical, elements. While embodiments of the instant disclosure are susceptible to various modifications and alternative forms, specific embodiments have been shown by way of example in the drawings and will be described in detail herein. However, one of skill in the art will understand that embodiments of the instant disclosure are not intended to be limited to the particular forms disclosed herein. Rather, the instant disclosure covers all modifications, equivalents, and alternatives falling within the scope of embodiments defined by the appended claims.

The shoe stability devices presented in the instant disclosure may include various features that provide support and/or stability for a shoe. According to some embodiments, a stability layer may result in a better fit, longer midsole life, and/or better support for a user's foot. The stability layer features and embodiments discussed herein may also provide various other advantages.

FIG. 1 is a perspective view of a shoe 100. Shoe 100 may include an outsole layer 110 attached to an upper section 120. Outsole layer 110 may comprise rubber, ethyl-vinyl-acetate (EVA), polyurethane (PU), phylon, rubber, fabric, or any other suitable material. Outsole layer 110 may also comprise any combination of suitable materials. Upper section 120 may also be made of any suitable material or combinations of materials.

Figure 2:
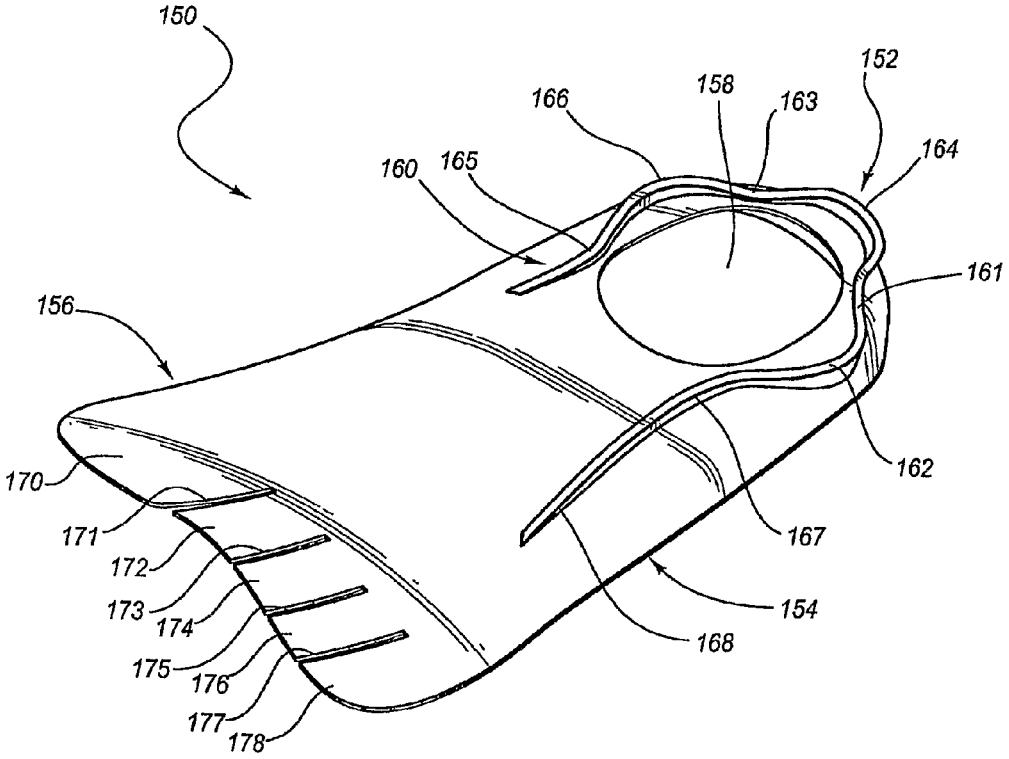
FIG. 2 is a perspective view of an exemplary stability layer according to certain embodiments.
Figure 6:
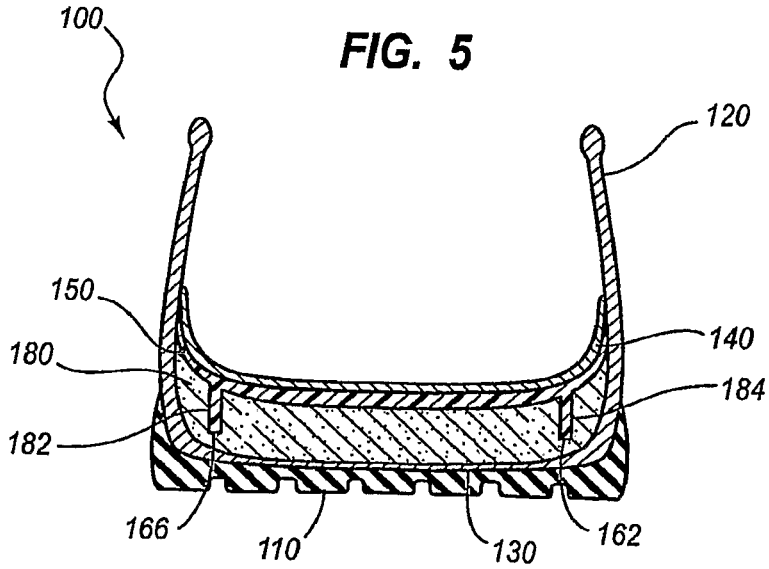
FIG. 6 is a cross-sectional back view of the exemplary shoe illustrated in FIG. 1.
Figure 7:
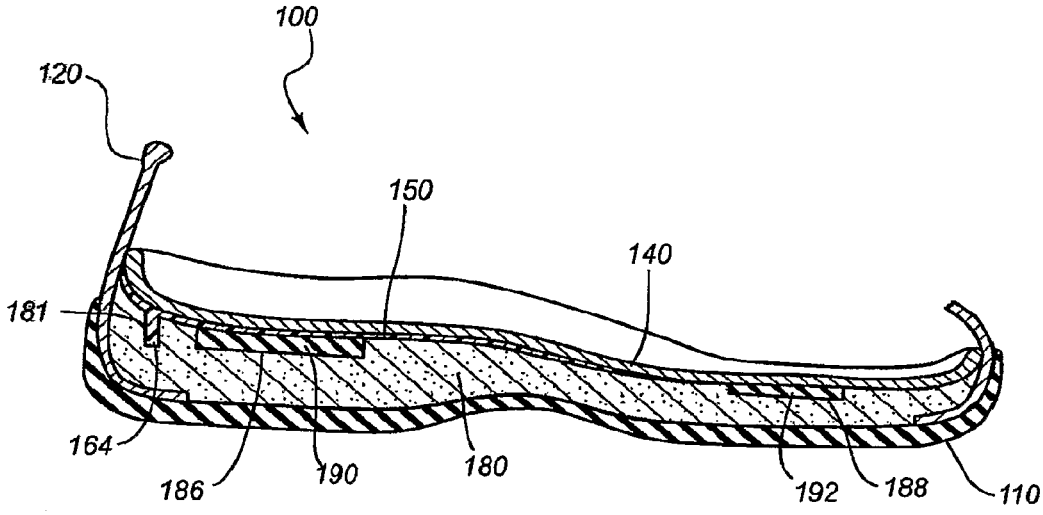
FIG. 7 is a cross-sectional side view of the exemplary shoe illustrated in FIG. 1.

FIG. 2 is a perspective view of a stability layer 150. Stability layer 150 may be dimensioned to be positioned within shoe 100. FIGS. 6 and 7 provide examples of how stability layer 150 may be positioned within shoe 100. A stability wall 160 may extend downward from a heel portion 152 of stability layer 150. In some embodiments, a mid-foot section 168 of stability wall 160 may extend downward from a mid-foot portion 154 of stability layer 150. Stability wall 160 may be a continuous wall that curves or snakes around heel portion 152, as shown in FIG. 2. In some embodiments, stability wall 160 may not be continuous (e.g., stability wall 160 may be divided into any number of non-continuous sections).

FIG. 2 illustrates that stability wall 160 may comprise various sections. For example, stability wall 160 may include a lateral side section 162, a back section 164, and a medial side section 166. As referred to herein, a lateral side section may be any stability wall side section designed to be situated underneath a lateral side or portion of a user's foot. Similarly, a medial side section may be any stability wall side section designed to be situated underneath a medial side or portion of the user's foot. As previously mentioned, stability wall 160 may also include a mid-foot section 168. Mid-foot section 168 may extend along a lateral side of stability layer 150. In some embodiments, stability wall 160 may include a mid-foot section that extends along a medial side of mid-foot portion 154 of stability layer 150. In certain embodiments, stability wall 160 may include mid-foot sections extending along both the medial and lateral sides of mid-foot portion 154 of stability layer 150. In at least one embodiment, stability wall 160 may not include any mid-foot sections.

Stability wall 160 may comprise at least one of medial side section 162 and/or lateral side section 166. For example, according to certain embodiments, lateral side section 162 may be a mirror image of medial side section 166, such that stability wall 160 is symmetrical. In other embodiments, stability wall 160 may not be symmetrical. For example, lateral side section 162 may not have the same shape, size, depth, and/or thickness as medial side section 166. In some embodiments, stability wall 160 may comprise only one or the other of lateral side section 162 and medial side section 166. In such embodiments, stability wall 160 may be asymmetrical because it lacks one of lateral side section 162 or medial side section 166.

FIG. 2 also illustrates that stability wall 160 may curve inward or indent at convex sections 161, 163, and 165. Convex sections 161, 163, and 165 may curve inward toward a middle of heel portion 152. Stability wall 160 may also include a convex section 167 between mid-foot section 168 and lateral side section 162. In some embodiments, stability wall 160 may comprise various other convex sections. In certain embodiments, stability wall 160 may comprise straight, rather than curved, sections.

FIG. 2 shows that stability wall 160 may be a part of stability layer 15*p*. In other embodiments, stability wall 160 may be a separate component from stability layer 150. In such embodiments, stability layer 150 may sit on top of stability wall 160. Stability wall 160 may be attached to stability layer 150 using glue or any other suitable attachment material or mechanism. In some embodiments, stability wall 160 may not be attached to stability layer 150. Stability layer 150 and stability wall 160 may be made of the same material or different materials. Stability layer 150 and stability wall 160 may be molded, machined, and/or crafted as one piece. Stability layer 150 and/or stability wall 160 may be made of fiberglass, thermoplastics, carbon fiber, metal, rubber, plastic, Thermo Poly Urethane, Thermoplastic Polyurethane (TPU), or any other suitable material. TPU and any other materials that may be molded for use as a shoe component are referred to herein as molded materials.

Stability wall 160 may also comprise various suitable heights and thicknesses. For example, stability wall 160 may be approximately one-eighth of an inch thick. In other embodiments, stability wall 160 may have any suitable thickness, including thicknesses greater or less than one-eighth of an inch. The thickness of stability wall 160 may affect the stiffness and/or stability of stability layer 150. For example, if greater stiffness and stability are desired in a certain portion of a shoe, stability wall 160 may be designed to be thicker in that portion. Similarly, if less stiffness and stability are desired in a certain portion of a shoe, stability wall 160 may be designed to be thinner in that portion. In other words, the thickness of stability wall 160 may vary in different sections and regions to provide different levels of stiffness and/or support within a shoe.

As shown in FIG. 2, stability layer 150 may also include a forefoot portion 156. Forefoot portion 156 may include toe sections 170, 172, 174, 176, and 178. Toe sections 170, 172, 174, 176, and 178 may be separated by slits 171, 173, 175, and 177. In some embodiments, slits 171, 173, 175, and 177 may be small enough that a user does not notice them while wearing a shoe that includes stability layer 150. Slits 171, 173, 175, and 177 may allow stability layer 150 to flex independently under each toe. Slits 171, 173, 175, and 177 may be any suitable length.

In some embodiments, toe section 170, which is designed to be positioned underneath a user's large toe, may extend forward further than other toe sections. An extended large toe section, such as toe section 170, may provide additional support for toe-off in a gait cycle. According to some embodiments, toe section 170 may be dimensioned to end before a ball region of a user's large toe.

In certain embodiments, stability layer 150 may not include forefoot portion 156. Eliminating forefoot portion 156 may allow additional flexing of a forefoot region of shoe 100. The additional flexing may result in shoe 100 having a barefoot feel to a user. In various embodiments, stability layer 150 may only include heel portion 152 (i.e., stability layer 150 may exclude forefoot and mid-foot portions 156 and 154). FIG. 2 also shows that stability layer 150 may include an opening 158. Opening 158 may expose a resilient and cushioning midsole material to provide additional comfort to a user. In some embodiments, stability layer 150 may not include opening 158.

Figure 3:
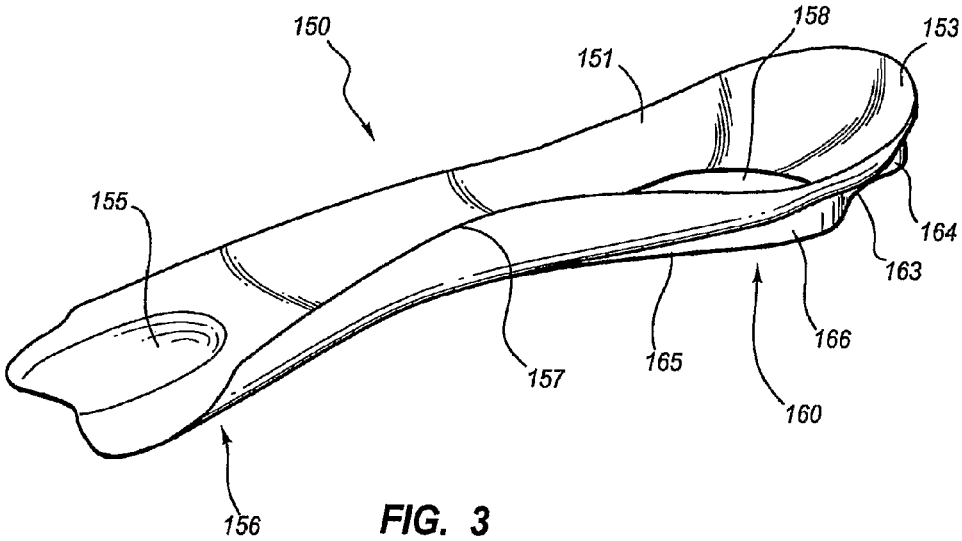
FIG. 3 is a perspective view of an exemplary stability layer according to certain embodiments.

FIG. 3 is another perspective view of stability layer 150. A top surface 151 of stability layer 150 may be substantially shaped and contoured to the shape of the bottom of a human foot. For example, top surface 151 may include a heel cup 153, which may also be referred to as a deep heel pocket. Stability layer 150 and top surface 151 may also rise in an arch section 157 of top surface 151. In other embodiments, stability layer 150 may not be raised in an arch section. In certain embodiments, top surface 151 may also include a raised area 155 under a metatarsal region of a foot. Raised area 155 may be dimensioned to support the bones in the metatarsal region of the foot. In some embodiments, raised area 155 may not be included in stability layer 150. Also, stability layer 150 may not necessarily include heel cup region 153.

FIG. 3 also shows that stability wall 160 may have varying heights in different sections. For example, back section 164 and medial side section 166 may be taller than convex portions 163 and 165. Various examples of heights of stability wall sections will be presented in the discussion of FIG. 4. In some embodiments, stability layer 150 may have varying thicknesses. For example, stability layer 150 may gradually become thinner towards a front of forefoot portion 156 to provide a smooth transition from stability layer 150 to an underlying midsole layer.

A front of forefoot portion 156 of stability layer 150 may have a concave shape such that medial and lateral sides of stability layer 150 extend further forward than a middle region of stability layer 150. A concave shape in the front of forefoot portion 156 may result in a more natural flexing of stability layer 150. Thus, a concave shape in the front of forefoot portion 156 may provide a more comfortable fit for a user.

Figure 4:
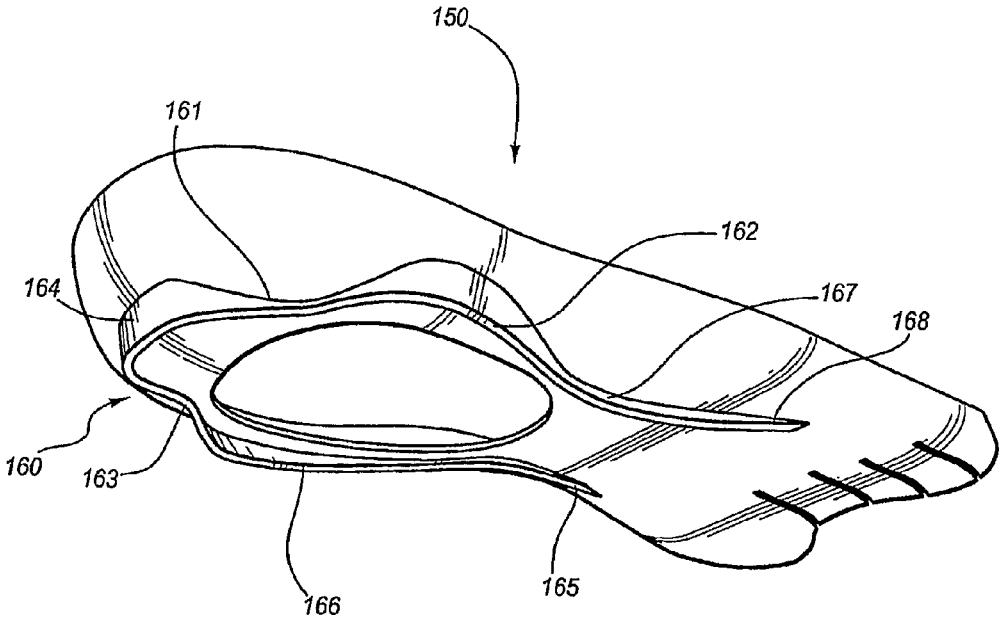
FIG. 4 is a perspective view of an exemplary stability layer according to certain embodiments.

FIG. 4 is another perspective view of stability layer 150. As shown in FIG. 4, back section 164 of stability wall 160 may be taller than convex portions 161 and 163. Similarly, lateral side section 162 may be taller than convex portions 161 and 167, and medial side section 166 may be taller than convex portion 163. Back section 164, lateral side section 162, and medial side section 166 may have heights of approximately one-fourth of an inch. According to some embodiments, back section 164, medial side section 166, and lateral side section 162 may have any suitable height, including heights greater or less than one-fourth of an inch. In some embodiments, back section 164, lateral side section 162, and medial side section 166 may have the same height, and in other embodiments they may have different heights. For example, back section 164 may extend several inches into a heel of a high-heeled shoe. The heights of the sections of stability wall 160 may be designed to control the rigidity, stability, and/or stiffness of stability layer 150.

As noted, stability wall 160 may include a back section 164, a medial side section 166, and a lateral side section 162. Stability wall 160 may also include other sections, such as convex sections 161 and 163. In some embodiments, stability wall 160 may not include convex sections 161 and 163 (e.g., stability wall 160 may comprise three unconnected sections: back section 164, medial side section 166, and lateral side section 162). In various embodiments, stability wall 160 may include any number of unconnected sections, and the unconnected sections may have any suitable shapes and sizes.

As shown in FIGS. 3 and 4, stability layer 150 may be shaped to curve upward around the sides of a foot. The curved design of stability layer 150 may provide a user with a more comfortable, supportive fit. In some embodiments, stability layer 150 may be flat and may not curve upward around the sides of a user's foot.

Figure 5:
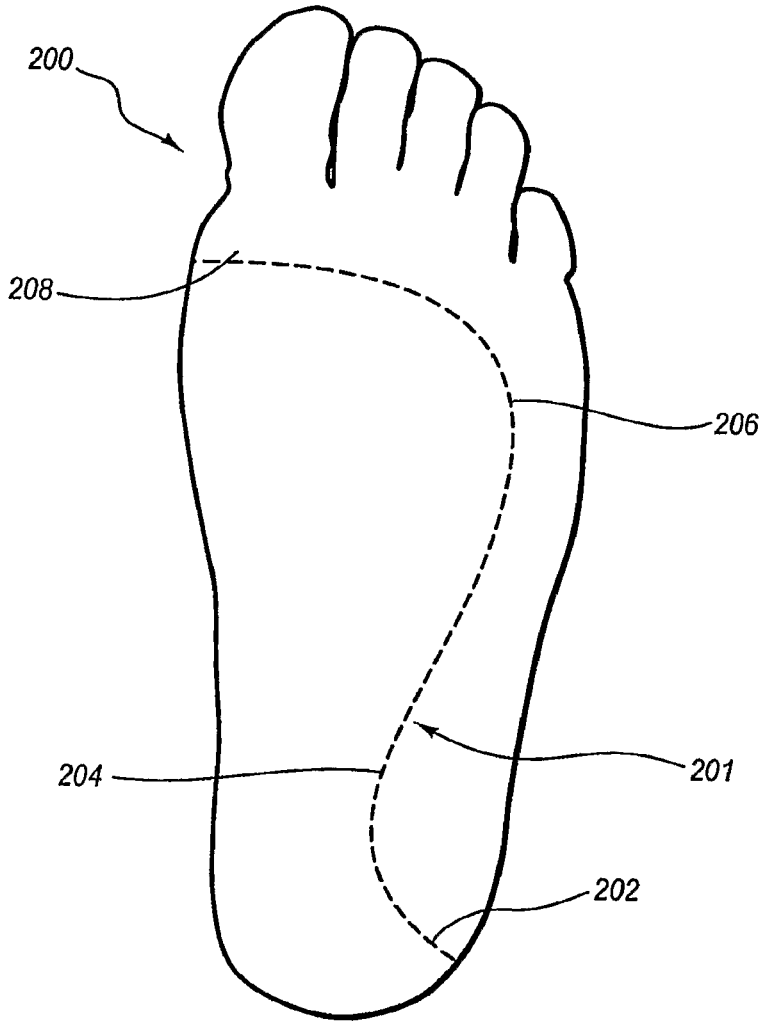
FIG. 5 is a perspective view of an exemplary gait cycle of a user's foot according to certain embodiments.

The shape and stiffness of stability wall 160 and stability layer 150 may, provide support and comfort through a user's gait cycle. Dotted line 201 in FIG. 5 illustrates how a load transfers across a user's foot 200 through the user's gait cycle. Foot 200 is a top view of a user's right foot. The gait cycle may begin when the user's heel strikes the ground at location 202, which is referred to herein as "heel strike." The pressure on foot 200 may transfer across the heel to location 204 and then on to location 206. As the user pushes off from the ball of the foot, and to some extent from the toes of the foot, the pressure on the user's foot transfers through location 208.

Stability wall 160 may be designed to help provide proper support and load transfer through a user's gait cycle. For example, the height of stability wall 160 at convex section 161 may be relatively short to help prevent premature pronation. When a foot initiates heel strike, it may begin to pronate. If a shoe is too stiff at a heel-strike location, the shoe may force the foot into premature pronation. In order to prevent premature pronation, the relative stiffness of stability layer 150 at convex section 161 may be lower than the stiffness of the stability layer 150 in other areas. Convex section 161 may be a stability wall section that corresponds to heel strike, and a short height of convex section 161 may provide flexibility for stability layer 150 at heel strike location 202. In addition, convex section 161 may be completely removed to prevent premature pronation.

Stability layer 150 may also be designed to provide stability for foot 200 as pressure on foot 200 transfers from location 202 to location 204. When pressure transfers from location 202 to location 204, foot 200 may begin to pronate and the heel of foot 200 may center itself within shoe 100. Stability layer 150 may be designed to prevent over-pronation during this transition from heel strike to heel centering. In some embodiments, stability layer 150 may become progressively stiffer during the transition from heel strike to heel centering. For example, medial side section 166, lateral side section 162, and back section 164 may be designed to provide stiffness for stability layer 150 through the transition from heel strike to heel centering. As previously noted, medial side section 166, lateral side section 162, and back section 164 may be taller than other sections of stability wall 160 and may therefore provide additional stability, stiffness, rigidity, and/or support for stability layer 150.

The increased stiffness and stability provided by medial side section 166, lateral side section 162, and back section 164 may also help properly center the heel of foot 200 within shoe 100. Furthermore, the increased stiffness may help stability layer 150 more effectively cradle or cup the heel of foot 200. In some embodiments, medial side section 166 may be taller than lateral side section 162. In such embodiments, the relative heights of lateral side section 162 and medial side section 166 may provide motion control that helps prevent over-pronation of foot 200.

Mid-foot section 168 of stability wall 160 may provide support for foot 200 as pressure on foot 200 transfers from location 204 to location 206. According to some embodiments, mid-foot section 168 may be shaped to coincide with the pressure transfer from location 204 to location 206. For example, as shown in FIG. 2, stability wall 160 may curve inward at convex section 167 and then curve outward at mid-foot section 168. This curving shape along convex section 167 and mid-foot section 168 may correspond to the transfer of pressure on a user's foot between locations 204 and 206.

In some embodiments, stability wall 160 may be a continuous wall. As a continuous wall, stability wall 160 may more effectively transfer energy through a midsole region of shoe 100 throughout a user's gait cycle. Also, a continuous stability wall may effectively dissipate energy from a point of impact throughout the midsole region of shoe 100. For example, stability wall 160 may be dimensioned to transfer a load from lateral side section 162 to medial side section 166. In some embodiments, stability wall 160 may be dimensioned to transfer a load from lateral side section 162 to mid-foot section 168.

Shaping stability wall 160 to correspond to a user's gait cycle may allow for longer life of a midsole region of shoe 100 while providing additional support and comfort to a user. According to some embodiments, stability wall 160 may transfer energy throughout shoe 100 in a manner that reduces hot spots (e.g., irritation due to increased pressure in a given area) during use of shoe 100. Furthermore, stability wall 160 may also distribute pressure in a manner that provides additional comfort to a user who may be standing still for an extended period of time.

FIG. 6 is a cross-sectional back view of shoe 100. Shoe 100 may comprise a lasting board 130 between outsole layer 110 and a midsole layer 180. Shoe 100 may also comprise stability layer 150 between midsole layer 180 and a top sheet 140. In some embodiments, top sheet 140 may also be referred to as a sock liner. According to some embodiments, midsole layer 180, stability layer 150, and top sheet 140 may be referred to as a midsole region. An upper section 120 may at least partially enclose the midsole region of shoe 100.

As shown in FIG. 6, medial side section 166 of stability wall 160 may extend downward from a heel portion 152 of stability layer 150. Similarly, lateral side section 162 of stability wall 160 may extend downward from heel portion 152. As illustrated in FIG. 6, medial side section 166 and lateral side section 162 may be perpendicular to stability layer 150.

In some embodiments, the entire stability wall 160 may be perpendicular to stability layer 150. In other embodiments, all or a portion of stability wall 160 may angle outward from stability layer 150 as it extends downwardly towards outsole 110. Angling stability wall 160 outward toward a perimeter of shoe 100 may result in an exaggerated cupping motion of heel portion 152 when heel portion 152 is under a load. For example, as a user's foot compresses stability layer 150 into midsole layer 180, stability wall 160 may move outward thus forcing the sides of heel portion 152 to cup around a user's foot. The cupping motion may provide improved comfort and stability for a user.

Midsole layer 180 may include openings 182 and 184. Openings 182 and 184 may be dimensioned to receive medial side section 166 and lateral side section 162. In some embodiments, openings 182 and 184 may be deeper than medial side section 166 and lateral side section 162. Thus, medial side section 166 and lateral side section 162 may travel downward relative to midsole layer 180 when a user's foot compresses stability layer 150 into midsole layer 180.

Stability wall 160 may function as a compression limiter for portions of midsole layer 180. For example, if a vertical load is not centered in the heel region of shoe 100 (e.g., if the load is centered at a medial or lateral side of the heel region), stability wall 160 may flex inward and may apply horizontal force to portion of midsole layer 180. As material in midsole layer 180 is vertically compressed, the material may try to displace in a horizontal plane. However, some midsole material may compress against stability wall 160. Thus, stability wall 160 may prevent some horizontal displacement of midsole material and enhance the support provided by shoe 100.

In certain embodiments, stability layer 150 may be positioned within midsole layer 180 such that midsole layer 180, rather than stability layer 150, contacts top sheet 140. In at least one embodiment, stability layer 150 may be completely enclosed within midsole layer 180. In other embodiments, stability layer 150 may be positioned beneath midsole layer 180. Thus, in certain embodiments, stability layer 150 may be positioned over a lasting board and under midsole layer 180.

FIG. 7 is a cross-sectional side view of shoe 100. FIG. 7 illustrates outsole layer 110 attached to upper layer 120. In some embodiments, upper layer 120 may be referred to as a shoe upper. Midsole layer 180 may be positioned above outsole layer 110, and stability layer 150 may be positioned above midsole layer 180. In some embodiments, stability layer 150 may be permanently attached to midsole layer 180. In other embodiments, stability layer 150 may rest on midsole layer 180 or may detachably connect to midsole layer 180. Stability layer 150 may effectively transfer loads to midsole layer 180.

Midsole layer 180 may be made of any suitable material, including highly cushioning and resilient materials such as EVA, phylon, PU, cork, rubber, gel, or other suitable materials. The hardness of the midsole material may vary depending upon the amount of support and cushioning required. In some embodiments, midsole layer 180 may have an AskerC hardness between 35 and 55. In various embodiments, midsole layer 180 may have any suitable AskerC hardness, including an AskerC hardness of less than 35 or greater than 55. In at least one embodiment, midsole layer 180 may have an AskerC hardness between 40 and 45. In some embodiments, stability layer 150 may have an AskerC hardness between 45 and 60. In various embodiments, stability layer 150 may have any suitable AskerC hardness, including an AskerC hardness of less than 45 or greater than 60. In at least one embodiment, stability layer 150 may have an AskerC hardness between 50 and 55.

Midsole layer 180 may include an opening 186 in a heel region. Opening 186 may be an oval-shaped cutout that is filled with a resilient material 190. In some embodiments, midsole layer 180 may not include opening 186. Resilient material 190 may have a different density or may be a different material than the rest of midsole layer 180. Resilient material 190 may be designed to provide additional support and/or cushioning for a user's heel. Resilient material 190 may be any suitable material, including PU, phylon, EVA, rubber, urethane, cork, or spring. A similar opening in a fore-foot region of midsole layer 180, opening 188, may be filled with resilient material 192. Resilient material 192 may provide additional support and/or cushioning to a metatarsal region of a user's foot. In some embodiments, opening 188 may extend the full thickness of midsole layer 180.

Midsole layer 180 may also include an opening 181. Opening 181 may be dimensioned to receive back section 164 of stability wall 160. Openings 181, 182, and 184 may form a single continuous opening dimensioned to receive stability wall 160. In some embodiments, opening 181 may have approximately the same height as back section 164. In other embodiments, opening 181 may be deeper than back section 164, which may allow back section 164 to move downward relative to midsole layer 180 when a user's foot compresses stability layer 150 into midsole layer 180.

Midsole layer 180 may be made of PU, EVA, PHYLON, or any other suitable material or combination of suitable materials. In some embodiments, midsole layer 180 may have varying densities to provide optimal comfort, control, stability, and/or performance characteristics in different regions of shoe 100. Stability layer 150 may be connected or bonded to midsole layer 180. In some embodiments, stability layer 150 may be bonded to a top surface of midsole layer 180 while stability wall 160 is not bonded to midsole layer 180. Such a construction may allow stability wall 160 to move within an opening in midsole layer 180 and may improve the ability of shoe 100 to absorb loads throughout a user's gait cycle.

According to certain embodiments, stability wall 160 may be attached to midsole layer 180. Stability layer 150 may be bonded to midsole layer 180 during a molding process of midsole layer 180. For example, when forming midsole layer 180, stability layer 150 may be placed inside a PU midsole mold prior to pouring the PU into the mold. As the PU is poured into the mold, it may set and bond to stability layer 150. Stability layer 150 may be manufactured using an injection process, a compression process, a machining process, or any other suitable manufacturing process.

In addition to controlling stiffness, stability, and motion, stability wall 160 may help position stability layer 150 in midsole layer 180 in certain manufacturing processes. For example, stability layer 150 and midsole layer 180 may be manufactured separately, and stability layer 150 may then be attached to midsole layer 180. In some embodiments, stability layer 150 may be properly positioned on midsole layer 180 by sliding stability wall 160 of stability layer 150 into an opening in midsole layer 180.

In some embodiments, shoe 100 may be manufactured in a strobel construction process with a traditional lasting board. Before or after upper section 120 is lasted to midsole layer 180, an opening may be stamped, cut, punched, or otherwise formed in midsole layer 180. Stability layer 150 may then be inserted into shoe 100 and may self-locate when stability wall 160 slides into the opening. This construction approach may result in a more solid and supportive interface between midsole layer 180 and stability layer 150.

Figure 8:
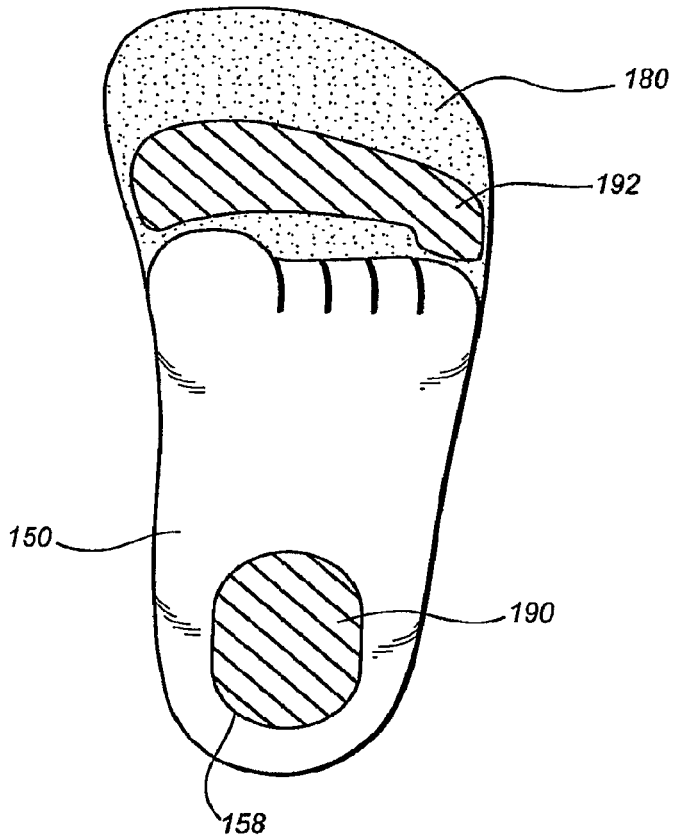
FIG. 8 is a top view of a stability layer on a midsole layer according to certain embodiments.
Figure 9:
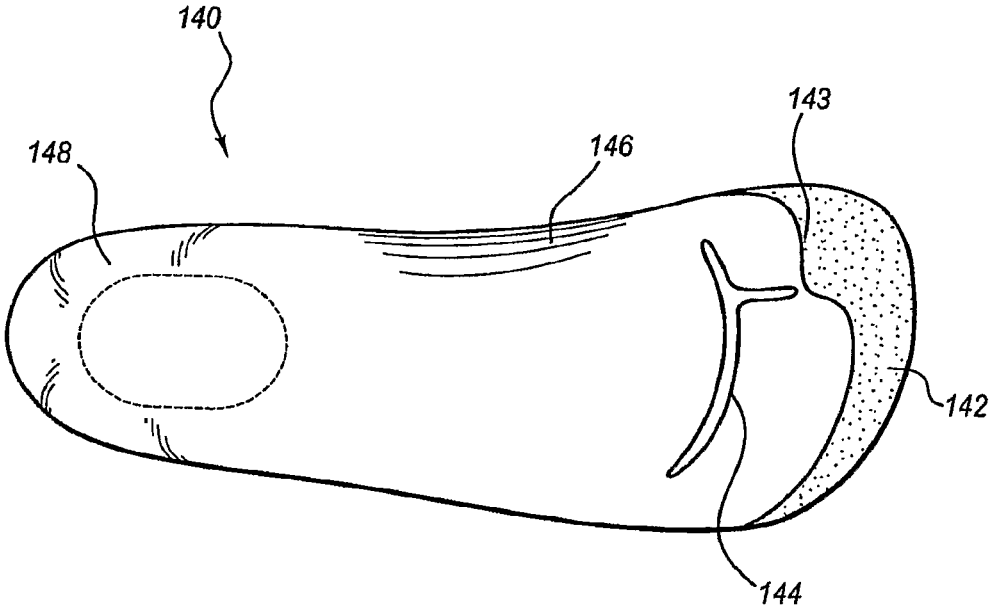
FIG. 9 is a top view of an exemplary top sheet according to certain embodiments.

FIG. 8 is a top view of midsole layer 180 and stability layer 150. Stability layer 150 may include an opening 158 that may expose a softer, more cushioning resilient material 190. As previously noted, a forefoot portion of midsole layer 180 may also include a resilient cushioning material 192. FIG. 9 is a top view of a top sheet 140 with a toe cover 142. Toe cover 142 may curve up and over a user's toes to provide protection for the toes. As shown in FIG. 9, toe cover 142 may be relatively large in a big toe area 143 to provide more protection for the big toe than for other toes. Toe cover 142 may be designed to provide adequate protection for the big toe while minimizing the amount of material needed to protect other toes. Toe cover 142 may also function as a toe box for the toe region of shoe 100. In many shoes, a rigid material is used to create and maintain the shape of the toe region. Toe cover 142 may eliminate the need of a rigid material toe box while serving the same function.

Top sheet 140 may be substantially contoured like a human foot with a cupped heel region 148 and a raised arch region 146. Top sheet 140 may be attached on top of stability layer 150 in the heel and mid-foot region, and top sheet 140 may be directly attached to midsole layer 180 in the forefoot region. Top sheet 140 may be manufactured of various materials, including memory foam, EVA, PU, sheet stock, urethanes, cork, rubber, other foams, or any other suitable material.

Top sheet 140 may comprise varying thicknesses throughout the length of the foot. Top sheet 140 may comprise a variety of fabrics or other suitable materials, including wicking, synthetic materials, leathers, perforated leathers, or textiles. Top sheet 140 may comprise slight recesses in heel and/or ball regions of the foot to receive a layer of highly resilient material designed to absorb shock. A toe bar feature 144 may be molded into a toe region of top sheet 140 to support a user's foot and prevent the foot from sliding out of a shoe or sandal that includes top sheet 140. In some embodiments, toe bar 144 may be molded into midsole layer 180.

Figure 10:
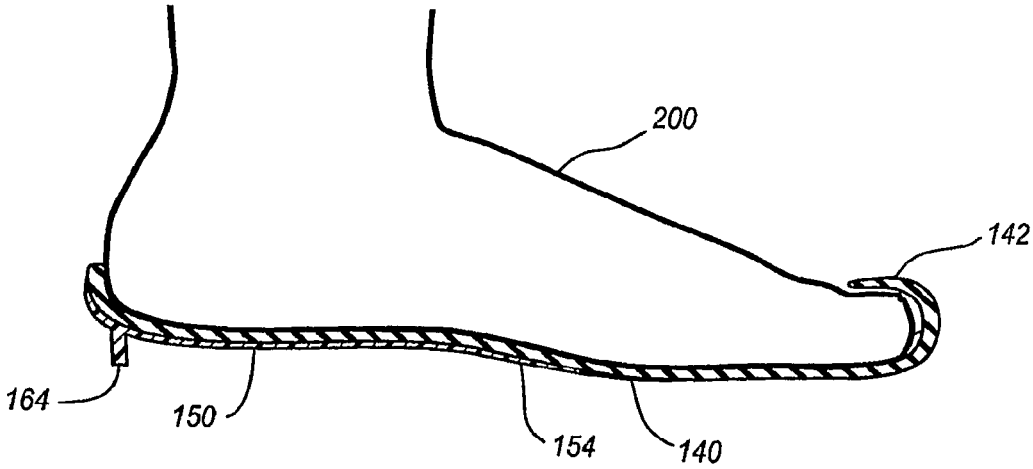
FIG. 10 is a cross-sectional side view of a stability layer and a top sheet according to certain embodiments.

FIG. 10 is a cross-sectional side view of foot 200 in top sheet 140. As shown, top sheet 140 may rest on or be attached to stability layer 150. Stability layer 150 may include stability wall back section 164. Stability layer 150 may taper in mid-foot region 154 to provide a smooth transition to top sheet 140. FIG. 10 also illustrates that toe cover 142 may be dimensioned to protect a user's toes.

Figure 11:
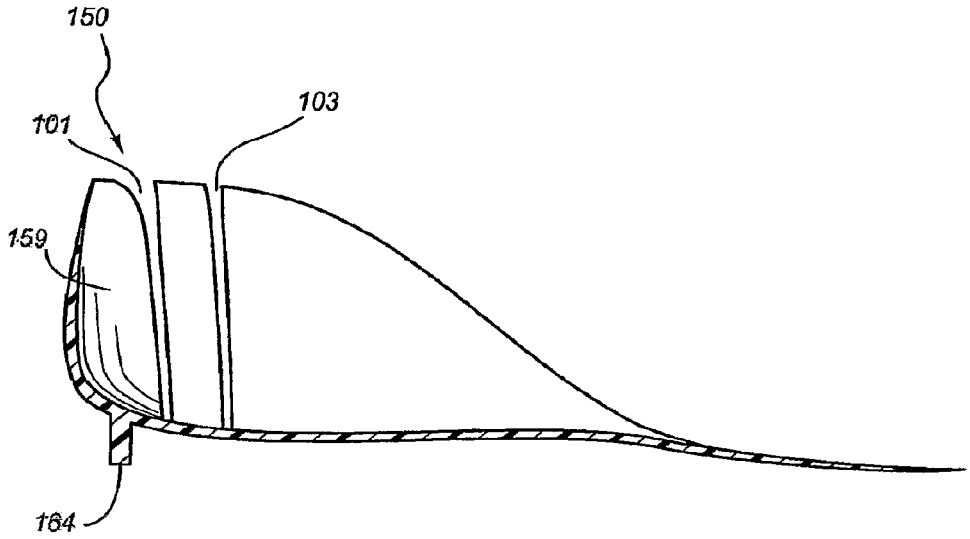
FIG. 11 is a cross-sectional side view of an exemplary stability layer according to certain embodiments.

FIG. 11 illustrates a cross-sectional side view of stability layer 150 with a heel counter 159 and a stability wall back section 164. In traditional manufacturing of many shoes, heel counters may be a part of the upper, not the midsole. The problem with having the heel counter separate from a midsole section is that the heel counter may not be able to effectively position the heel in dynamic loading situations. In contrast, heel counter 159 may be an integral part of stability layer 150 and may therefore be an integral part of a midsole region. Heel counter 159 may include side and back portions that fit around a user's heel. Heel counter 159 may be various heights, shapes, and sizes. Heel counter 159 may also includes slits 101 and 103, which may provide additional flexibility for heel counter 159. In some embodiments, heel counter 159 may not include slits 101 and 103.

Figure 12:
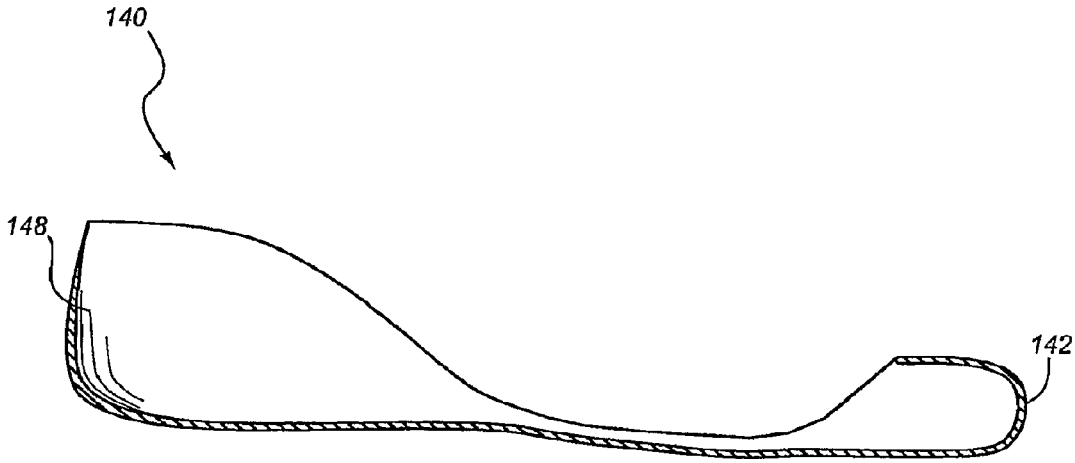
FIG. 12 is a cross-sectional side view of an exemplary top sheet according to certain embodiments.

FIG. 12 illustrates a cross-sectional side view of top sheet 140 with a heel region 148 and toe cover 142. Top sheet 140 may be used in conjunction with a stability layer 150 that comprises a heel counter 159 and a stability wall back section 164. Top sheet 140 with heel region 148 may help create a better fit for a shoe, especially around the heel. As shown in FIGS. 11 and 12, heel counter 159 of stability layer 150 and heel region 148 of top sheet 140 may have deep heel pockets. These deep heel pockets may allow a user's foot to fit more securely into a shoe. In addition, the deep heel pockets may force a heel's fatty tissue under the calcaneous bone to stay directly under the bone, thereby promoting the natural cushioning effect of the heel's fatty tissue. Deep heel pockets may also enhance the benefits of stability wall 150 by helping to center a user's foot over a midsole region of shoe 100.

Figure 13:
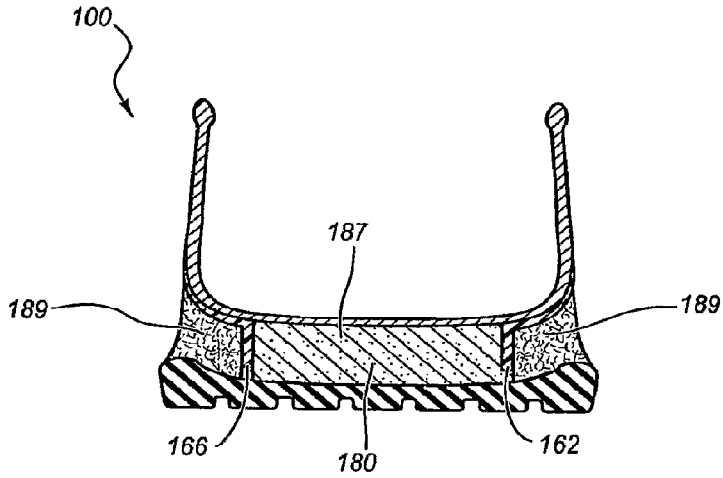
FIG. 13 is a cross-sectional back view of the exemplary shoe illustrated in FIG. 1.

FIG. 13 is a cross-sectional back view of shoe 100, similar to the view shown in FIG. 6. FIG. 13 illustrates that midsole layer 180 may include different materials in center region 187 than in side regions 189. As shown, side regions 189 may be the regions outside stability wall sections 166 and 162. Side regions 189 may comprise any suitable material, including gel, EVA, PU, cork, rubber, or phylon. In some embodiments, side regions 189 may include air pockets, gel material, softer TPU material, or other materials suitable for support, cushioning, energy return, and/or stability.

In some embodiments, such as the embodiment shown in FIG. 13, stability layer 150 may be implemented in a strobel lasted construction. In a strobel lasted construction, midsole layer 180 may be positioned underneath a strobel lasting board. In other words, upper section 120 may not wrap around shoe 100. Instead, upper section 120 may be stitched to a flexible lasting board. The flexible lasting board may be bonded or otherwise attached to a top surface of midsole layer 180. Two examples of how a stability layer may be included in a strobel lasted construction are presented below.

First, a stability layer insert may be placed inside a shoe in the same manner that a traditional sockliner may be placed inside a shoe. The strobel lasting board may include an opening dimensioned to receive a stability wall of the stability layer insert. Such a construction may facilitate load transfer from the stability wall to a midsole layer of the shoe. Furthermore, the stability wall may serve as a locating device for the stability layer insert, thus improving fit, support, and performance. This stability layer insert may be similar to the stability insert 310 shown in FIG. 14.

Second, a stability layer may be positioned on top of a midsole and below a strobel lasting board, as illustrated in FIG. 13. In such a construction, a shoe may require a separate sockliner that is not attached to the stability layer. A strobel lasted upper may be bonded, glued, or otherwise attached to a top of the stability layer, which may also be a top of the midsole.

In strobel lasted constructions, the stability layer may have a heel counter that extends vertically around the heel, as shown in FIG. 11. The heel counter may be molded as one piece with the stability layer. In some embodiments, the heel counter may be made of different density materials than the stability layer. When manufacturing the heel counter, the heel counter may extend upwardly around an exterior of the upper and may be bonded, glued, or otherwise attached to the upper. Such a construction may expose the heel counter at the exterior of the shoe. In other embodiments, the heel counter may be inserted into the upper such that the heel counter is embedded in the upper. In various embodiments, the heel counter may be manufactured to fit inside the upper.

In some embodiments, a heel counter of a stability layer may be inserted through the lasting board of the upper into an interior of the upper. Such constructions may result in the heel counter being on the inside of the shoe, closest to a user's foot. In certain embodiments, an inner surface of the heel counter (e.g., the surface that touches a user's foot) may include a resilient material, textile, fabric, or any other suitable material, that may be bonded or otherwise attached to the upper to accommodate a wearer's foot and improve comfort and fit.

Figure 14:
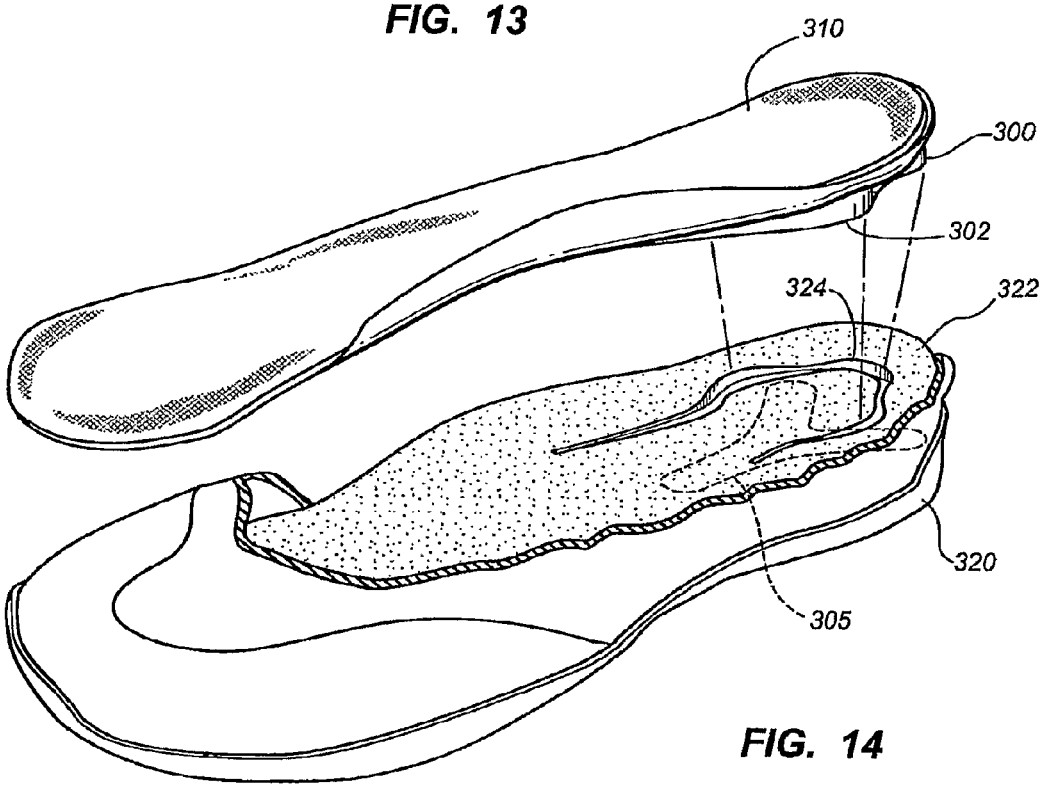
FIG. 14 is a perspective view of an exemplary shoe with a stability insert according to certain embodiments.

FIG. 14 illustrates a stability layer 300, an insole 310, and a shoe 320. In some embodiments, stability layer 300 may be incorporated into insole 310 to provide an aftermarket insole with stability inserts features and/or functions. According to other embodiments, stability layer 300 may be designed to be attached to the bottom of a traditional aftermarket insole. Stability layer 300 may also be used with traditional custom orthotics. In certain embodiments, shoe 320 may include an opening 324 in midsole 322. Opening 324 may be shaped to receive a stability wall 302 of stability layer 300. In some embodiments, stability layer 300 may be designed for use with traditional shoes that do not have an opening for a stability wall.

FIG. 14 also illustrates a stiffening shank 305 positioned beneath stability wall 302. Stiffening shank 305 may provide additional stiffness against bending shoe 320 in a heel portion. Such stiffness may compensate for regions of stability wall 300 that may be less stiff or rigid (e.g., a section of stability wall 300 that is flexible enough to prevent premature pronation at heel strike). In some embodiments, shoe 320 may not include stiffening shank 305.

Figure 15:
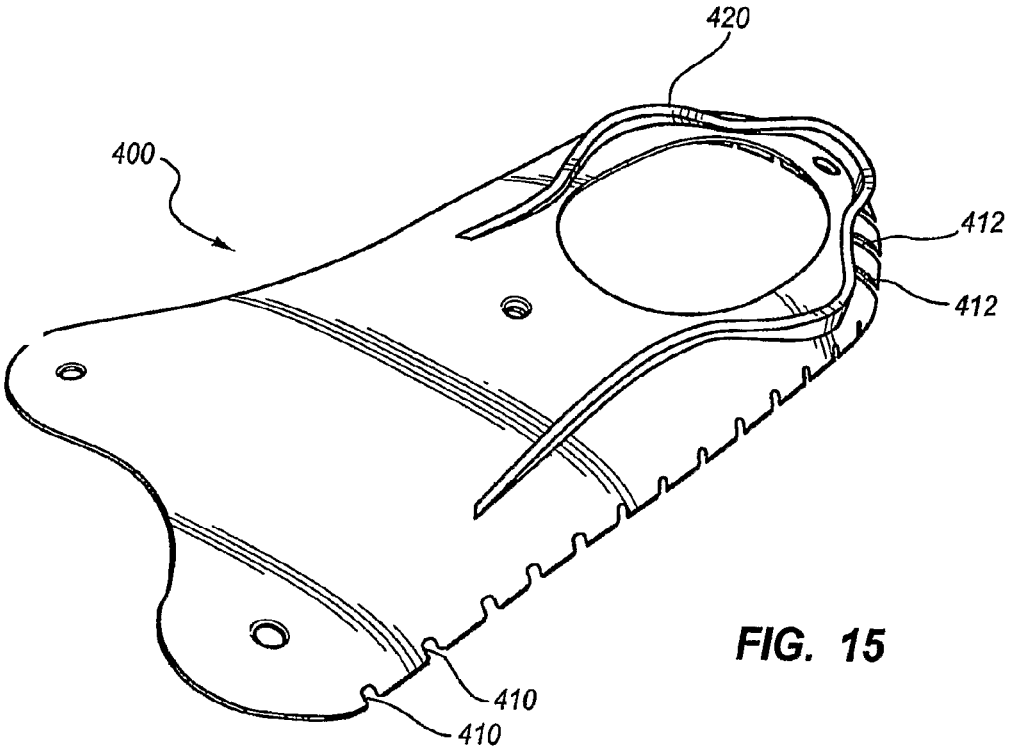
FIG. 15 is a perspective view of an exemplary stability layer according to certain embodiments.

FIG. 15 is a perspective view of a stability layer 400 with slits 410. Slits 410 may provide additional flexibility for stability layer 400. Slits 410 may also increase efficiency in manufacturing a midsole that includes stability layer 400. Slits 410 may have any suitable size or shape. Some slits, such as slits 412, may extend from a perimeter of stability layer 400 to a stability wall 420 of stability layer 400. Slits 410 and 412 may also be referred to as notches.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising."

What is claimed is:

1. A shoe comprising:

a stability layer positioned within the shoe and dimensioned to flex to cup around a user's heel;

a stability wall formed as one piece with the stability layer, wherein the stability wall extends downward from a heel portion of the stability layer and is dimensioned to angle outward from the stability layer when the stability layer is compressed under the user's heel, the stability wall comprising:

a back section dimensioned to curve around a back side of the heel portion of the stability layer;

a lateral side section and a medial side section, the lateral side section extending along a lateral side of the heel portion of the stability layer, the medial side section extending along a medial side of the heel portion of the stability layer, wherein the stability wall is continuous through the back section, the lateral side section, and the medial side section;

a midsole layer positioned below the stability layer, the midsole layer comprising an opening, wherein:

a hardness of the midsole layer is less than a hardness of the stability wall, the stability wall extends downward from a bottom surface of the stability layer and through a surface of the midsole layer such that the stability wall is positioned within the opening in the midsole layer, the stability layer is positioned over the stability wall and the midsole layer such that, when the stability layer is compressed under the user's heel, the stability wall forces sides of the stability layer to cup around the user's heel, the stability wall curves around a central heel portion of the stability layer in a generally U-shaped manner to form a void, and a heel portion of the midsole layer fills the void.

2. The apparatus of claim 1, wherein the stability wall is generally perpendicular to the stability layer.

3. The apparatus of claim 1, wherein the stability wall comprises varying heights.

4. The apparatus of claim 3, wherein the back section of the stability layer is taller than inwardly curved convex portions of the medial and lateral side sections of the stability layer.

5. The apparatus of claim 1, wherein the lateral side section of the stability wall comprises a convex portion that curves inward.

6. The apparatus of claim 1, wherein the stability layer comprises varying thicknesses.

7. The apparatus of claim 6, wherein a forefoot portion of the stability layer is thinner than the heel portion of the stability layer.

8. The apparatus of claim 1, wherein:

the stability layer comprises a mid-foot portion;

the stability wall comprises a mid-foot section that extends downward from the mid-foot portion of the stability layer, the mid-foot section extending along a lateral side of the stability layer.

9. A shoe comprising:

a stability layer positioned within the shoe and dimensioned to flex to cup around a user's heel;

a stability wall formed as one piece with the stability layer, wherein the stability wall extends downward from a heel portion of the stability layer and is dimensioned to angle outward from the stability layer when the stability layer is under a load, the stability wall comprising:

a lateral side section extending along a lateral side of the heel portion of the stability layer;

a medial side section extending along a medial side of the heel portion of the stability layer, the stability wall being dimensioned to transfer a load from the lateral side section to the medial side section;

a midsole layer positioned below the stability layer and comprising an opening, wherein:

a hardness of the midsole layer is less than a hardness of the stability wall, the stability wall curves around a central heel portion of the stability layer to form a void, a heel portion of the midsole layer fills the void, the stability wall extends through a surface of the midsole layer such that the stability wall is positioned within the opening in the midsole layer, the lateral side section of the stability wall comprises a first convex portion that curves inward, and the medial side section of the stability wall comprises a second convex portion that curves inward.

10. The apparatus of claim 9, wherein at least one of the medial and lateral side sections angles outward from a vertical direction from the stability layer downward towards an outsole of the shoe.

11. The apparatus of claim 9, wherein:

the stability layer comprises a mid-foot portion;

the stability wall comprises a mid-foot section that extends downward from the mid-foot portion of the stability layer, the mid-foot section extending along a lateral side of the stability layer, wherein the stability wall is dimensioned to transfer a load from the lateral side section to the mid-foot section.

12. The apparatus of claim 9, wherein the stability wall is dimensioned to induce a cupping motion of the heel portion of the stability layer.

13. The apparatus of claim 9, wherein the stability layer comprises an opening in the heel portion of the stability layer.

14. The apparatus of claim 9, wherein a perimeter of the heel portion of the stability layer comprises a plurality of slits.

15. The apparatus of claim 9, wherein the stability layer comprises a heel counter.

16. The apparatus of claim 9, wherein the lateral side section of the stability wall comprises a first concave portion that curves outward, and the medial side section of the stability wall comprises a second concave portion that curves outward.

17. The apparatus of claim 9, wherein the midsole layer comprises a cushioning material.

18. The apparatus of claim 9, wherein the midsole layer comprises at least one of:

an AskerC hardness between 35 and 55;

an AskerC hardness between 45 and 60.

19. The apparatus of claim 9, further comprising a stiffening shank positioned below the stability layer.

20. A method comprising:

providing a stability layer dimensioned to be positioned within a shoe and to flex to cup around a user's heel, the stability layer comprising a stability wall, wherein the stability wall:

extends downward from a heel portion of the stability layer, is dimensioned to angle outward from the stability layer and force sides of the stability layer to cup around the user's heel when the stability layer is under a load, comprises a back section dimensioned to curve around a back side of the heel portion of the stability layer, comprises a lateral side section that extends along a lateral side of the heel portion of the stability layer, comprises a medial side section that extends along a medial side of the heel portion of the stability layer, and is continuous through the back section, the lateral side section, and the medial side section;

providing a shoe, the shoe comprising a midsole layer, the midsole layer comprising an opening, wherein a hardness of the midsole layer is less than a hardness of the stability wall;

positioning the stability layer on the midsole layer such that the stability wall extends downward from a bottom surface of the stability layer and through a surface of the midsole layer, wherein the stability wall extends into the opening in the midsole layer, wherein the stability wall curves around a central heel portion of the stability layer in a generally U-shaped manner to form a void and a heel portion of the midsole layer fills the void.

21. The apparatus of claim 1, wherein:

the stability wall is dimensioned to induce a cupping motion of the heel portion of the stability layer.

22. The apparatus of claim 1, wherein:

the stability layer is shaped to curve upward around the sides of a foot.

23. The apparatus of claim 1, wherein:

the stability layer is configured within the shoe such that the stability layer functions as a compression limiter for portions of the midsole layer.

24. The apparatus of claim 1, wherein:

a heel counter forms an integral part of the stability layer by the heel counter and the stability layer being formed of the same molded material.

25. The apparatus of claim 24, wherein:

the heel counter is manufactured as part of a midsole region of the shoe rather than an upper of the shoe.

26. The apparatus of claim 25, wherein:

the stability wall does not extend to a periphery of the stability layer.

27. The apparatus of claim 1, wherein:

the stability wall comprises a substantially continuous curve that comprises:

the back section as a concave curve around the back side of the heel portion of the stability layer;

the lateral side section as a concave curve around the lateral side of the heel portion of the stability layer;

a first convex section that corresponds to heel strike and that curves inward and connects the back section and the lateral side section.

28. The apparatus of claim 27, wherein:

the continuous curve of the stability wall comprises:

the medial side section as a concave curve;

a second convex section that curves inward and connects the back section and the medial side section.

29. The apparatus of claim 27, wherein:

the continuous curve of the stability wall comprises an additional convex section that connects the lateral side section or the medial side section to a forefoot area.

30. The apparatus of claim 27, wherein:

the first convex section is shorter than the back section and the lateral side section.

31. The apparatus of claim 1, wherein:

the opening in the midsole layer is deeper than at least a portion of the stability wall to allow the portion of the stability wall to travel downward relative to the midsole layer when the user's foot compresses the stability layer into the midsole layer.

* * * * *